US005216949A

United States Patent [19]

Bertozzi

[11] Patent Number: 5,216,949

[45] Date of Patent: Jun. 8, 1993

[54] CONVEYOR FOR TRANSPORTING LASAGNE AND SIMILAR FORMS OF PASTA THROUGH A DRIER

[75] Inventor: Fausto Bertozzi, Parma, Italy

[73] Assignee: Barilla G.e.R. F. lli - Societa per Azioni, Parma, Italy

[21] Appl. No.: 890,112

[22] Filed: May 29, 1992

[51] Int. Cl.[5] ..... F26B 19/00

[52] U.S. Cl. ..... 99/483; 34/204; 34/218; 99/479; 198/797; 198/803.13; 198/952

[58] Field of Search ..... 99/443 C, 483, 386, 99/470, 404, 468, 477–479; 34/203, 204, 216–218, 206, 233; 426/458, 451; 198/797, 812, 952, 803.13

[56] References Cited

U.S. PATENT DOCUMENTS

| | | | |
|---|---|---|---|
| 1,339,092 | 5/1920 | Benjamin | 34/204 |
| 2,631,383 | 3/1953 | Bettini | 34/204 |
| 3,094,398 | 6/1963 | Samson | 34/203 |
| 4,231,470 | 11/1980 | Parkes | 198/812 |
| 4,699,048 | 10/1987 | Pavan | 99/470 |
| 4,702,161 | 10/1987 | Andersen | 99/483 |
| 4,775,542 | 10/1988 | Manser et al. | 426/458 |
| 4,784,053 | 11/1988 | Barnhart | 99/443 C |
| 5,026,567 | 6/1991 | Manser et al. | 426/451 |
| 5,050,318 | 9/1991 | DuBruyn | 198/803.13 |
| 5,062,221 | 11/1991 | Fazion | 34/218 |

FOREIGN PATENT DOCUMENTS

| | | | |
|---|---|---|---|
| 587689 | 4/1958 | Italy | 34/204 |

*Primary Examiner*—Timothy F. Simone

*Attorney, Agent, or Firm*—Sughrue, Mion, Zinn, Macpeak & Seas

[57] ABSTRACT

A conveyor for transporting fresh lasagne through a drier includes a plurality of container-supports substantially like cylindrical cages and each having a plurality of radial pockets for receiving and holding the lasagne. The containers are mounted removably on a conveyor with parallel chains and roll relative to the chains as they pass through the drier.

8 Claims, 7 Drawing Sheets

CONVEYOR FOR TRANSPORTING LASAGNE AND SIMILAR FORMS OF PASTA THROUGH A DRIER

BACKGROUND OF THE INVENTION

The present invention relates to a conveyor for transporting lasagne and similar, flat forms of pasta through a drier, including at least one pair of parallel chains which are supported and driven by respective sprockets along a path extending through the drier from a station for the loading of the fresh pasta to a station for the discharge of the dried pasta, and a plurality of containers for the lasagne, the containers being arranged transversely between the chains and removably associated therewith for transportation along the path.

It is well known that, during the production of dry pasta, the drying is the most important stage and the most awkward to carry out. In fact, it is closely linked and correlated with the organoleptic characteristics of the pasta produced, its hygienic qualities and, not least, its preservability, that is, its shelf life. It is also known that good drying can even improve the aforementioned characteristics in comparison with those which can be expected solely on the basis of the ingredients used to produce the starting dough.

The success of a dried pasta, and not only its commercial success, can be attributed essentially to the drying stage, the techniques used and the manner in which it is carried out.

From this point of view, the continual care taken to improve the technique and the means of drying fresh pasta is perhaps taken for granted.

Amongst the variables which add to the complexity of an investigation into the best manner of and means for effecting the drying are the shape of the pasta to be dried and the manoeuvrability of such a shape during the drying.

Thus, up to now, in the case of, for example, lasagne, the best drying technique provides for the lasagne to pass through the drier lying on flat cloths or wide supporting trays in a single layer so that both of their faces are exposed to the heat-flow to an equal extent.

As is known, because the lasagne lie flat, and also because the heat treatment to which they are subjected is gentle, the lengths of the driers are generally such as to constitute a problem from the point of view of the useful, and hence expensive, space that they take up.

Moreover, the driers generally have suitable heating, temperature-control and humidity-control devices which are distributed along the drier and are operated so as to achieve experimentally-predetermined temperature and humidity curves throughout the lengths of the driers, in order to dry the fresh pasta in an optimal manner. The temperature curves are closely linked to the times for which the lasagne remain in the driers.

The temperature curve selected, the time taken, the fact that the lasagne lie flat on the cloths or trays, and the hourly production rate (which must at least be acceptable from a commercial point of view) mean that it is necessary to produce and use very bulky and, in particular, very long driers.

The space taken up, the high costs of production, operation and maintenance, and the difficulty of controlling the temperature and humidity in the drier are the most readily apparent problems related to the considerable lengths of the driers which up to now have been used at an industrial level.

SUMMARY OF THE INVENTION

The problem upon which the present invention is based is that of providing a conveyor for transporting lasagne and similar forms of pasta through a drier which has structural and functional characteristics such that the dimensions and, in particular, the length of the drier are substantially smaller than those of conventional driers, without involving changes to the drying process and, what is more, without affecting the quality of the dried product (pasta).

According to the invention, the problem is solved by a conveyor for transporting lasagne and similar forms of pasta through a drier, including at least one pair of parallel chains which are supported and driven by respective sprockets along a path extending through the drier, and a plurality of containers for the lasagne, the containers being arranged transversely between the chains and associated removably therewith for transportation along the path, characterized in that each of the containers includes a pair of discs keyed to opposite ends of a hollow shaft, a plurality of stiffening bars fixed to the discs in positions spaced evenly at predetermined intervals around their peripheries, a first plurality of rectangular cloths arranged radially between the discs, each cloth being stretched between a respective bar and the hollow shaft with which it is removably associated, a second plurality of rectangular cloths, each of which has one side fixed to a corresponding cloth and extending parallel to the hollow shaft at a predetermined distance therefrom and an opposite side which is associated removably with a rod the opposite ends of which are restrained on and bear against respective peripheral edges of the discs, each cloth cooperating with the corresponding cloth to form a pocket for housing lasagne to be dried, and means for moving the rods and their cloths against resilient means between a position in which the pocket is closed and in which the cloths are close together and a position in which the pocket is open and in which the cloths are angularly spaced apart.

The advantages and characteristics of the invention will become clearer from the following description of an embodiment of a conveyor according to the invention with reference to the appended drawings, which are given by way of non-limiting example.

DETAILED DESCRIPTION OF THE INVENTION

Figure 1:
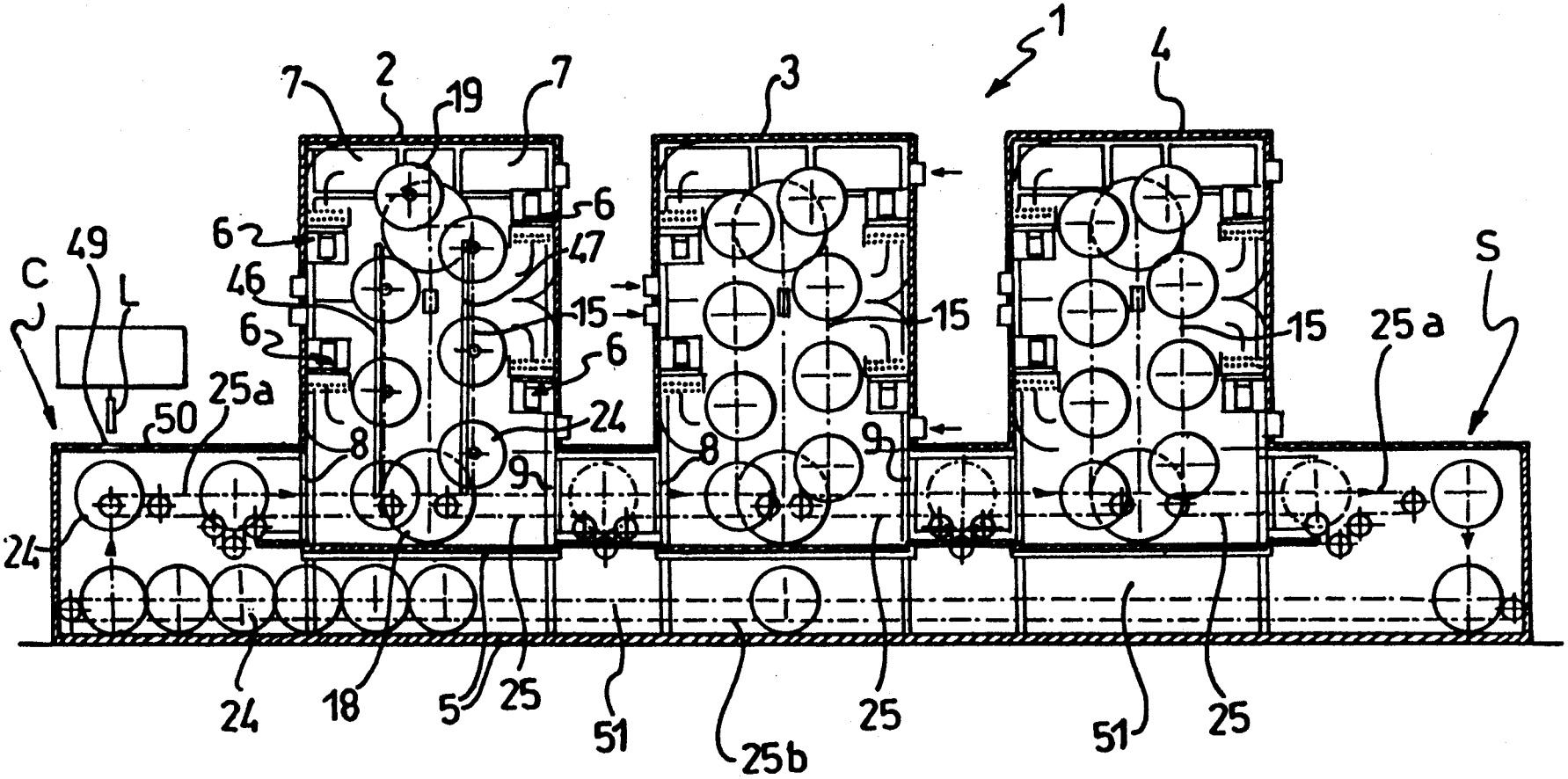
FIG. 1 shows schematically a drier using a lasagne conveyor according to the invention.

With reference to the drawings, a drier for pasta in general and for lasagne and similar forms of pasta in particular is schematically and generally indicated 1.

According to an embodiment which is preferred but not therefore exclusive, the drier 1 is of the type including a plurality of structurally independent drying chambers 2, 3 and 4 aligned and spaced apart on a base 5.

Such a drier is described fully in the copending Italian patent application No. MI91A001114 which was filed on Apr. 23rd 1991 in the name of the present Applicant and is included herein for reference.

The drying chambers 2 to 4 are preferably all the same and are all similarly equipped, that is to say, they are modular chambers and, in the following description, reference will therefore be made to only one chamber, unless otherwise stated.

Each drying chamber has conventional internal regulation means 6, 7, not shown in detail, for controlling and monitoring all the factors which affect the pasta-drying process, particularly the temperature, the relative humidity, the pressure, etc., as well as devices for admitting steam, air and anything else required to achieve and maintain climatic-ambient conditions which are predetermined in accordance with a preferred pasta-drying curve.

At the bottom of each drying chamber is a pasta-inlet port 8 and a pasta-outlet port 9 which can be closed hermetically by conventional gates, not shown, operated, for example, pneumatically, in known manner.

Figure 2:
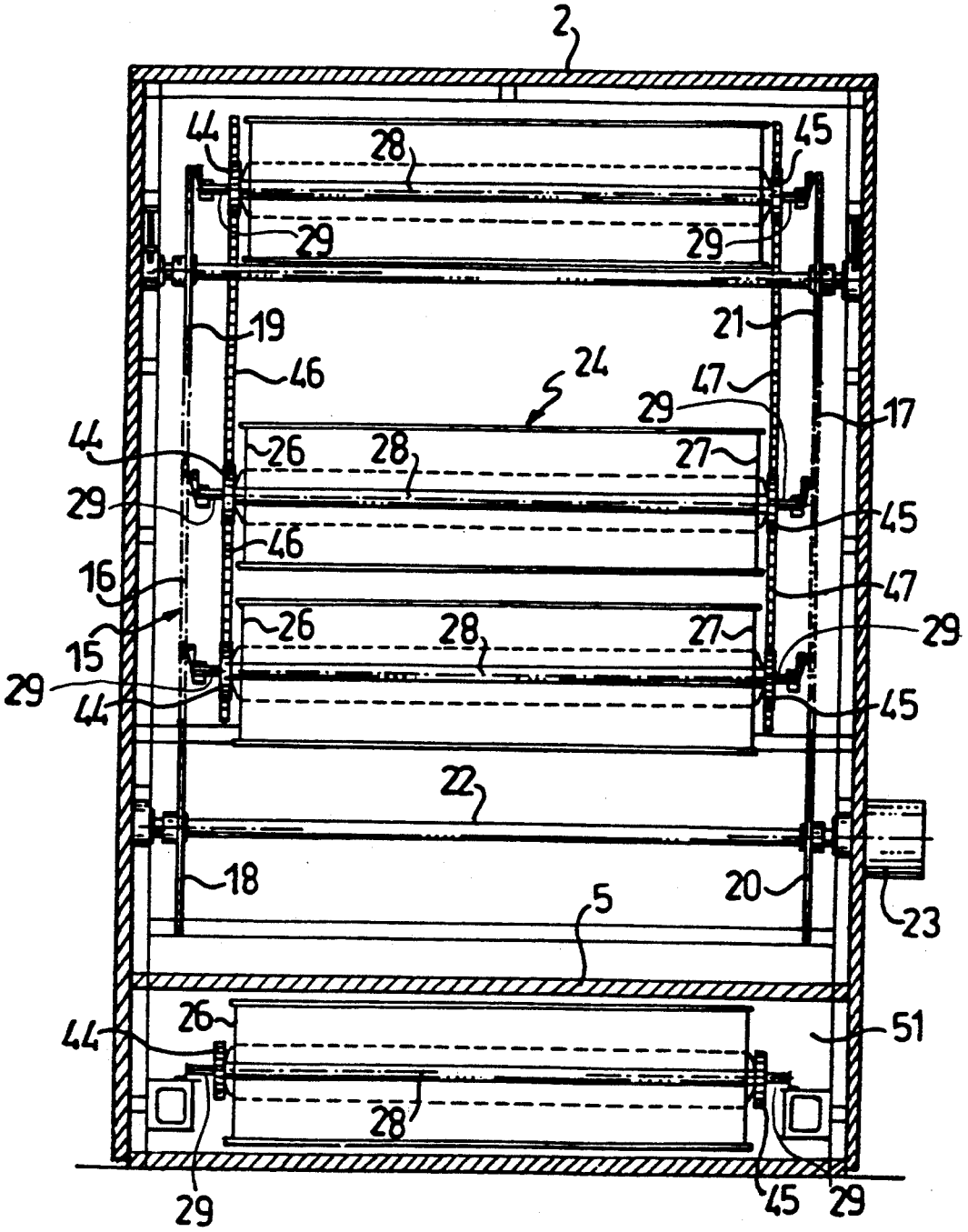
FIG. 2 shows a drying chamber of the drier of FIG. 1 on an enlarged scale and in cross-section.

With reference to FIG. 2, a vertical conveyor 15 installed in each of the drying chambers 2 to 4 is preferably endless and of the type including two parallel, spaced-apart chains 16, 17 driven by respective sprockets 18, 19 and 20, 21. The sprockets 18, 20 are both keyed to the same shaft 22 which extends in correspondence with the pasta inlet and outlet ports and is driven by a motor 23 which is supported outside the drying chamber in question.

Container-supports for the lasagne to be treated thermally in the drying chambers are associated removably with corresponding links of opposed chains 16, 17. Between the drying chambers 2 to 4 is a further chain conveyor 25 (FIG. 1) which, when required, can take a container-support 24 from a conveyor 15 of one chamber and transfer it to the conveyor 15 of the next chamber.

Figure 3:
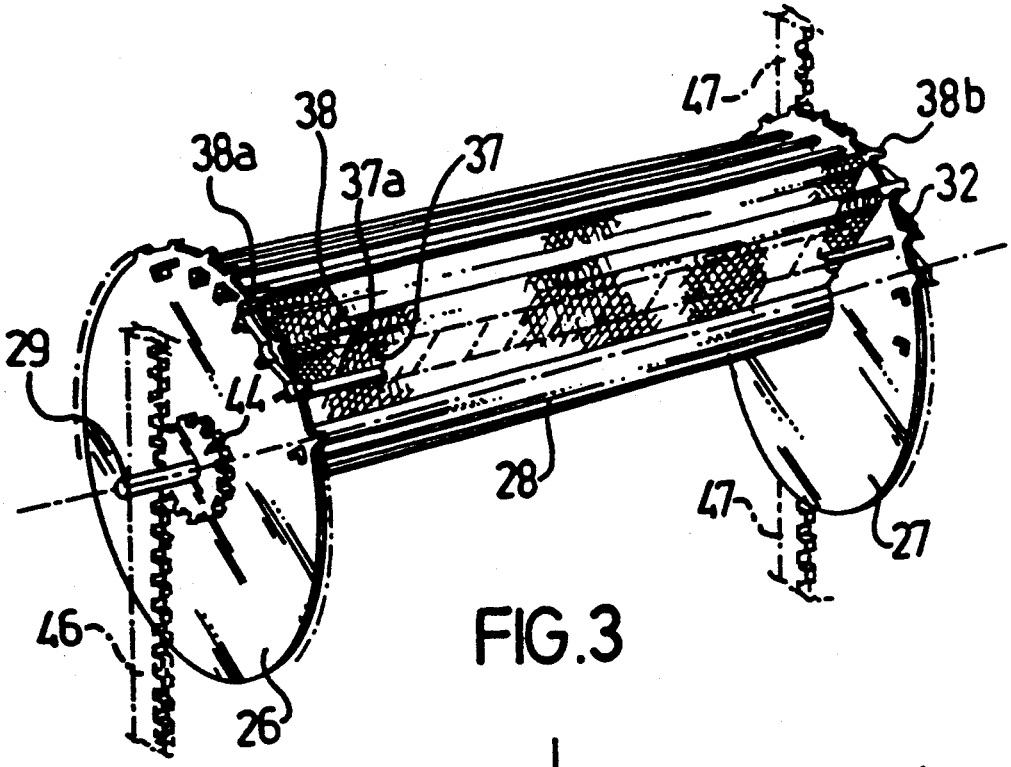
FIG. 3 is a partially-sectioned perspective view of a lasagne container-support of the conveyor of the invention, on an enlarged scale.
Figure 4:
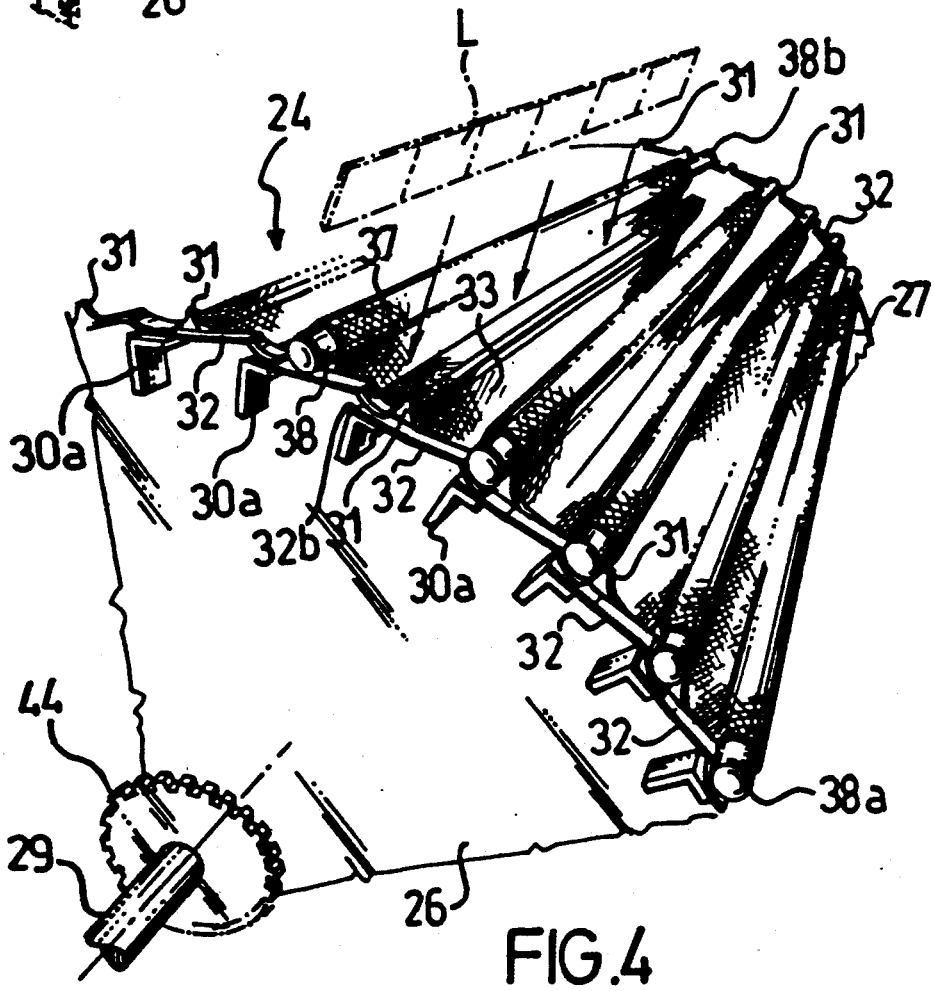
FIGS. 4 and 5 show structural details of the containers of FIG. 3, in perspective and on an enlarged scale.

With reference to FIG. 3 and the subsequent drawings, each of the container-supports 24 includes essentially a pair of discs 26, 27 keyed to opposite ends of a hollow shaft 28 which in turn is rotatable on a pin 29 extending axially through the shaft.

The discs 26, 27 are also interconnected by a plurality of stiffening bars 30 (FIG. 5) spaced evenly at predetermined intervals around the peripheries of the discs, near their edges. Short portions 30*a* of the bars 30 project outwardly of the discs 26, 27.

The bars 30, which make the container-support 24 look substantially like a cylindrical cage, are preferably constituted by L-shaped profiles fixed to the discs 26, 27 in an arrangement such that one flange of each is oriented radially and their other flanges are all oriented in the same sense, for example, clockwise.

In correspondence with each of the bars 30, the discs 26, 27 have respective coplanar projections 31, 31*a* with flattened points, extending radially from the circular edges of the discs and connected suitably thereto.

The end of a rectangular, flat spring 32 is fixed to the other flange of the portion 30*a* of each bar 30 outside the discs 26, 27 and its other, free end bears on the portion 30*a* of an adjacent bar 30.

Figure 5:
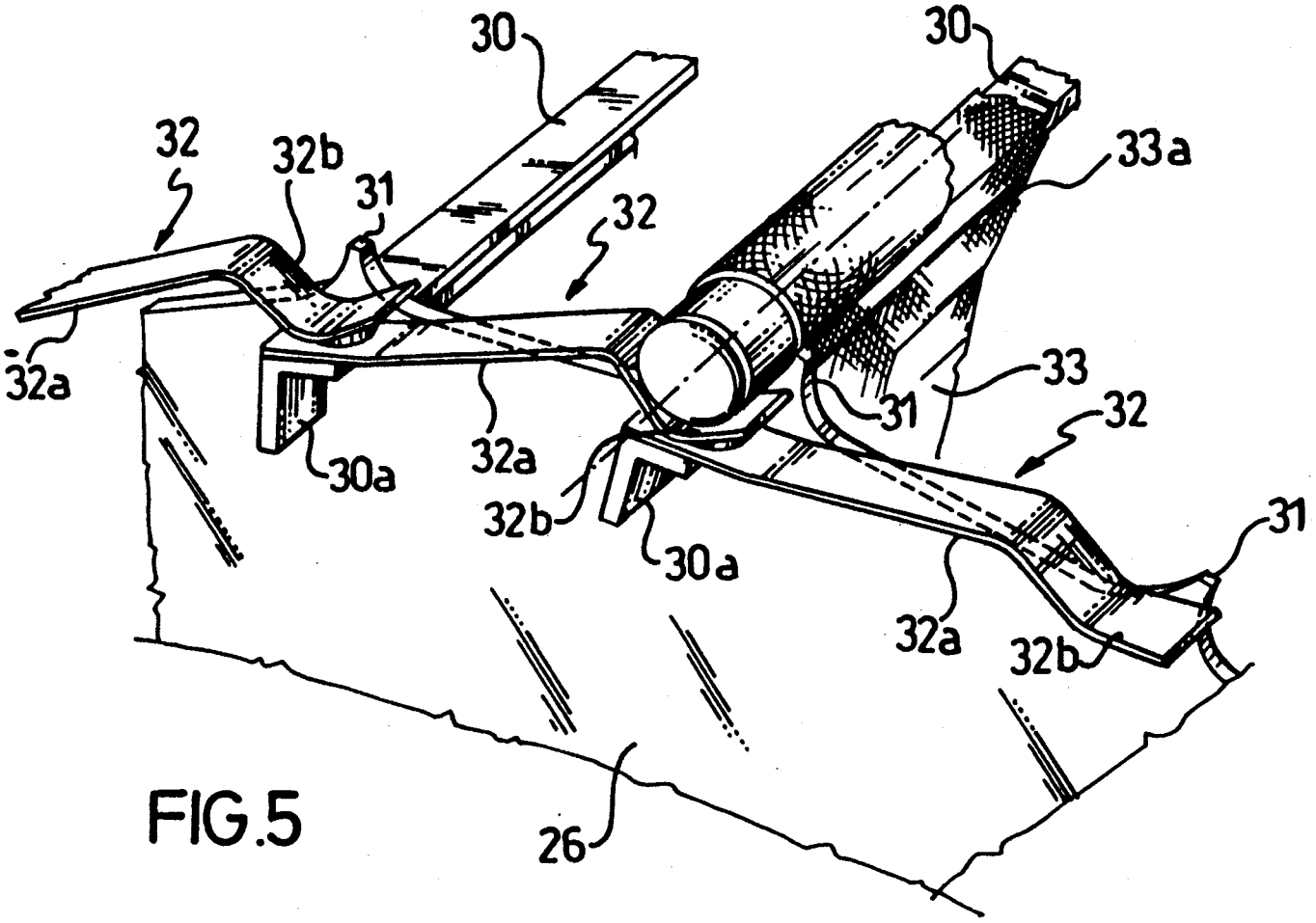

In particular, and with reference to FIG. 5, the springs 32 are arranged in a circle substantially coaxial with the discs 26, 27, the free end of each spring in the circle being superposed and bearing on the fixed end of the preceding spring. Each spring 32 includes a longer, inclined portion 32*a* and a curved, substantially spoon-shaped portion 32*b* which opens outwardly of the discs 26 and 27 and constitutes the free end of the spring. It should be noted that the substantially spoon-shaped, curved portions 32*b* are positioned in correspondence with the pointed projections 31, 31*a* of the discs 26, 27.

A first plurality of rectangular cloths 33 is supported between the discs, the cloths being disposed radially and equiangularly spaced at the centre. Each cloth 33 is stretched between a corresponding bar 30 and the shaft 28. For this purpose, opposite sides of the cloth 33 have respective hems 33*a*, 33*b*.

The hem 33*a* is fitted onto a respective bar 30 and a rod 34 (FIG. 6), which is intended to be engaged removably in a corresponding longitudinal seat 35 in the shaft 28, is fitted (threaded) through the other hem 33*b*.

In particular, and according to a preferred embodiment, the shaft 28 has a plurality of recesses 36 with circular internal portions of which the diameters are larger than the widths of the recesses themselves and which constitute the seats 35.

A second plurality of cloths 37 (FIGS. 6 and 7) is supported between the discs 26, 27, each cloth being associated with a corresponding cloth 33 so as to form a pocket (T) for housing the pasta (lasagne) to be dried, as will become clearer from the following description.

One side of each cloth 37 is parallel to the shaft 28 and has a hem 37*a* in which a cylindrical rod 38 is fitted, the rod 38 having end portions 38*a*, 38*b* (FIG. 3) which are outside the hem 37*a* and bear on corresponding opposed springs 32.

The side of the cloth 37 opposite and parallel to that with the hem 37*a* is sewn, or otherwise fixed throughout its length, to the cloth 33 at a predetermined distance from the shaft 28. Each cloth 37 is stretched so that the rod 38 bears against the respective opposed springs 32 of the discs 26, 27 with a predetermined force.

If the cylindrical rod 38 is moved from one end of each of the springs 32 on which it is engaged to the other, the cloth 37 is moved angularly from a position in which it is spaced from the cloth 33 (in which the pocket is open) to a position in which it is closer to and substantially beside the cloth 33 (and in which the pocket is closed).

To advantage, in the latter position (in which the pocket is closed) the opposite ends 38*a*, 38*b* of each cylindrical rod 38 are engaged in the curved spoon-shaped ends of the springs 32 of the opposed discs 25, 26. In this position, the rods 38 are further positively retained since they bear against the pointed projections 31, 31*a* of the discs, which constitute effective stops for preventing the rods 38 from being released in the wrong direction, as will become clearer from the following description.

Corresponding gears 44, 45 are fixed coaxially to the outer walls of the discs 26, 27 for engaging respective racks 46, 47 which extend beside the chains 16, 17 along predetermined portions of the path which the containers-supports 24 have to follow through the drier of the invention.

In particular, and in the case of the multi-chambered drier described above, the racks 46, 47 extend in correspondence with the vertical portions of the conveyors 15 in the individual drying chambers.

As a result of this engagement, the container-supports 24 are forced to roll as they move along the path.

The drier 1 of the invention includes a station C immediately upstream of the first drying chamber 2 for the loading of the lasagne to be dried, and a station S immediately downstream of the last drying chamber 4 for discharging the dried pasta.

In order to load the lasagne to be dried into each of the container-supports 24, the normally-closed pockets formed by the cloths 33 and 37 have to be opened in succession. In the former condition (in which the pockets are closed) the rods 38 which support the cloths 37 are restrained in the spoon-shaped free ends **32*b* of the springs 32 with the cooperation of the rounded sides of the respective peripheral, pointed projections 31 of the discs 26, 27**.

In order to open the pockets, the rods 38 therefore have to be disengaged from the spoon-shaped ends **32*b* and then moved along the inclined portions 32*a* of the springs 32 to their fixed ends, against the corresponding pointed projections 31**.

The open pockets are closed by carrying out these movements of the rods in reverse.

Figure 6:
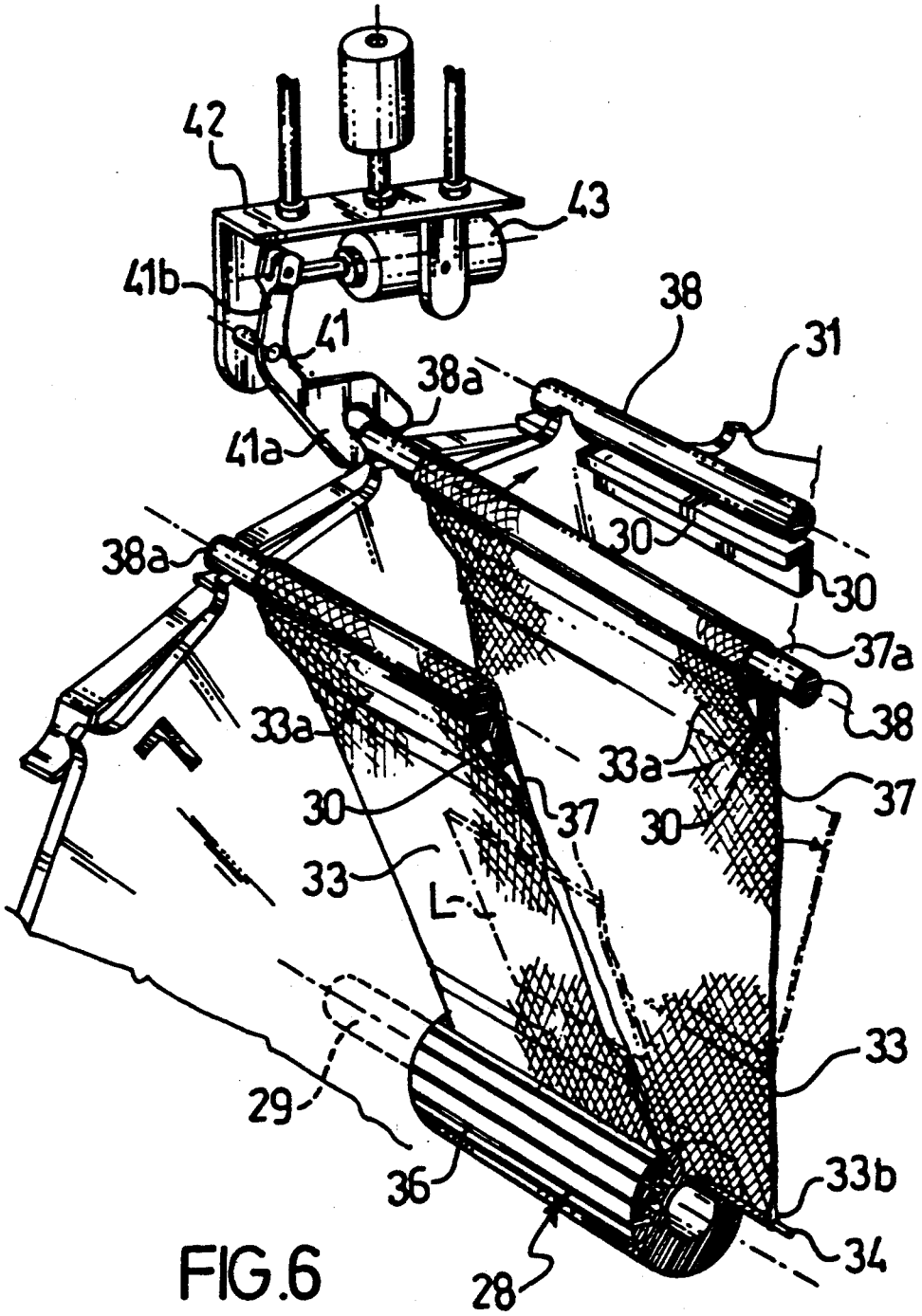
FIG. 6 is a partially-sectioned, perspective view showing the same detail as FIG. 4 from the interior of the lasagne container-support, on an enlarged scale.
Figure 7:
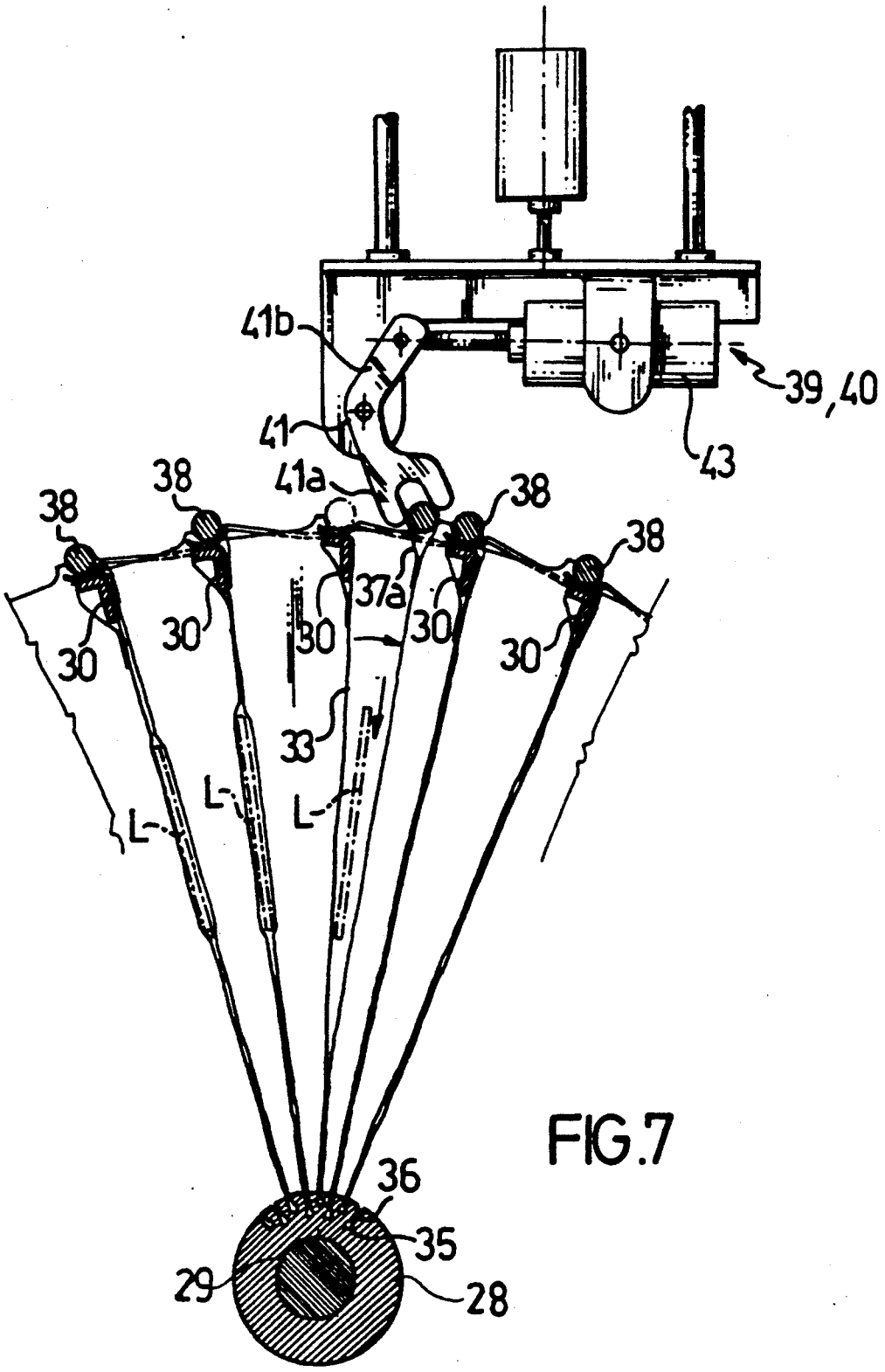
FIG. 7 is a side view of the same detail as FIG. 6, FIGS. 8 and 9 show, in perspective and schematically, certain arrangements of the container of FIG. 3 at the output and at the input of the drier of FIG. 1, respectively.

A pair of devices, generally indicated 39 and 40 in FIGS. 6 and 7, is used for moving the rods 38 along the springs 32.

Each of these devices includes essentially a lever 41 which pivots on a support 42 with its pivoting axis parallel to the axis of the shaft 28 and has a fork-shaped operative end **41*a* for engaging a corresponding portion 38*a* or 38*b* of a cylindrical rod 38. The powered end 41*b* of the lever 41 is driven by a pneumatic cylinder 43 supported by the support 42** mentioned above.

As described above, the lasagne are loaded into the container-supports 24 in the station C. For this purpose, when the container 24 is in the position indicated **24*a*, the top vertical pocket which is aligned, for example, with a lasagne-loading aperture 49 in the top 50 of the loading station C (FIG. 1**) is opened.

Figure 9:
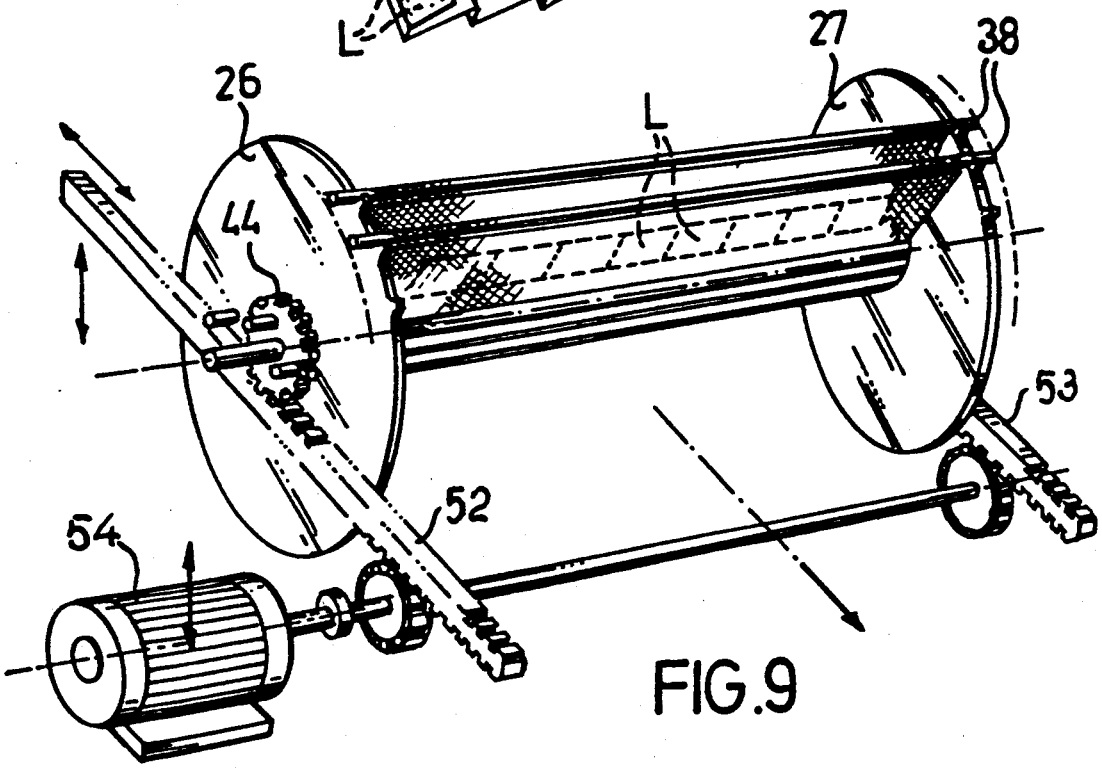

Two racks 52, 53 (FIG. 9), which extend horizontally in order to engage the gears 44, 45 of the container 24, are used in the station C for positioning the container 24 angularly in order to position each of its pockets in the vertical lasagne-loading position. The racks 52, 53, which are driven by a brushless motor 54, are guided vertically in known manner, not shown.

A strip of rolled pasta dough L (a lasagna) is loaded (for example, inserted) into the open pocket from above as it leaves a device known as a lasagna-making machine which is well known and is therefore not described herein since it is irrelevant for the purposes of an understanding of the present invention.

At this point, the pocket is closed and the container-support 24 in question is rotated through an angle such as to bring a new, closed pocket to the vertical position, a new sheet of lasagna to be dried being inserted in the new pocket after it has been opened in the manner already described.

When all the pockets of a container-support 24 have been filled with respective strips of rolled pasta dough S, the container 24 is taken by a conveyor **25*a* (just like the conveyors 25 between one drying chamber and another) and transferred to the first drying chamber 2. In this drying chamber, the container is picked up by the ascending pass of the conveyor 15 in a known, conventional manner, not shown, in order to perform one or more circuits within the drying chamber 2. As it travels upwards, and as it travels downwards on the other pass of the same conveyor 15, the gears 44, 45 of the container support 24 engage the respective racks 46, 47 so that the container-support 24 rolls as it moves along the conveyor 15**.

After one or more circuits on the conveyor 15 of the first drying chamber (the number of circuits depends upon the predetermined period to be spent by each container 24 in the chamber) the container is withdrawn by the conveyor 25 and transferred to the next drying chamber 3. When it is discharged from the last drying chamber 4, the container-support 24 with the fully dried lasagne is transferred to the unloading station S in which the steps already described for loading the fresh lasagne to be dried are carried out in reverse with the use of a set of motor-driven racks the same as those shown in FIG. 9 and a similar device (39–40) for opening and closing the pockets of the containers 24.

Figure 8:
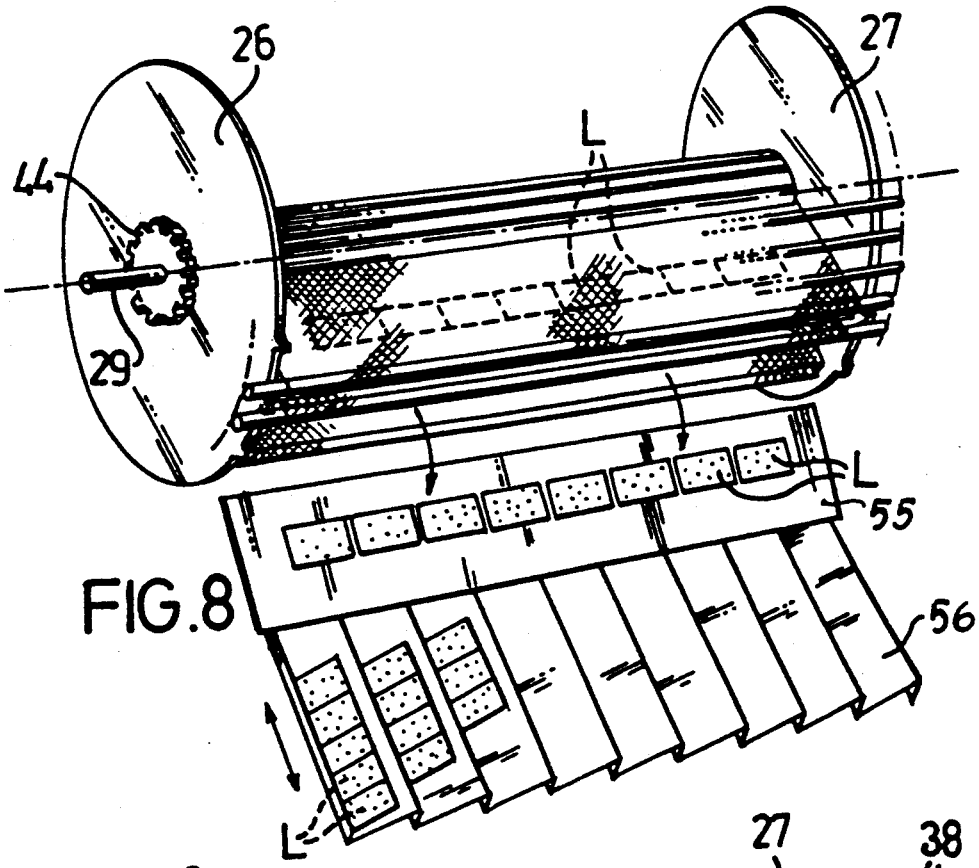

In particular, in the station S, the lasagne fall from the preselected pockets onto a corresponding chute 55 (FIG. 8) from which they are passed onto a vibrating table 56 of the saw-toothed type for aligning the lasagne.

The empty containers from which the dried lasagne have been removed are returned to the loading station C. To advantage, a further conveyor **25*b* extending along a tunnel 51 which, to advantage, is formed in the base 5 of the drier 1** of the invention is used for this purpose.

What is claimed is:

1. A conveyor for transporting lasagne and similar forms of pasta through a drier, including at least one pair of parallel chains which are supported and driven by respective sprockets along a path extending through the drier, and a plurality of containers for the lasagne, the containers being arranged transversely between the chains and associated removably therewith for transportation along the path, characterised in that each of the containers includes a pair of discs keyed to opposite ends of a hollow shaft, a plurality of stiffening bars fixed to the discs in positions spaced evenly at predetermined intervals around their peripheries, a first plurality of rectangular cloths arranged radially between the discs, each cloth being stretched between a respective bar and the hollow shaft with which it is removably associated, a second plurality of rectangular cloths, each of which has one side fixed to a corresponding cloth and extending parallel to the hollow shaft at a predetermined distance therefrom and an opposite side which is associated removably with a rod the opposite ends of which are restrained on and bear against respective peripheral edges of the discs, each cloth cooperating with the corresponding cloth to form a pocket for housing lasagne to be dried, and means for moving the rods and their cloths against resilient means between a position in which the pocket is closed and in which the cloths are close together and a position in which the pocket is open and in which the cloths are angularly spaced apart.

2. A conveyor according to claim 1, characterised in that opposite sides of each cloth of the first plurality of cloths have respective hems, one hem being fitted removably onto a respective stiffening bar and a rod, which is engaged removably in a corresponding longitudinal seat in the hollow shaft, being fitted into the other hem.

3. A conveyor according to claim 2, characterised in that the shaft has a plurality of longitudinal recesses each having a substantially circular inner portion with a diameter larger than the width of the recess itself, the inner portion constituting the seat for housing a corresponding rod and the respective hem of the cloth.

4. A conveyor according to claim 1, characterised in that each cloth of the second plurality of cloths has a hem into which a corresponding cylindrical rod is fitted removably.

5. A conveyor according to claim 1, characterised in that the resilient means comprise a plurality of rectangular flat springs associated externally with each disc and arranged in a circle substantially coaxial with the discs, near the edges thereof, each spring having an end which is fixed to the end of a respective stiffening bar, its other, free end bearing on the fixed end of the next spring in the circle.

6. A conveyor according to claim 5, characterised in that each of the springs includes a longer inclined portion and a substantially spoon-shaped curved portion which opens outwardly of the discs and constitutes the free end of the spring, the opposite ends of the rods being engaged in the substantially spoon-shaped, curved portions of corresponding springs of the discs in the condition in which the pockets are closed.

7. A conveyor according to claim 1, characterised in that respective gears for engaging rack portions arranged along the path of the conveyor through the drier are fixed externally to the discs for rotation therewith.

8. A conveyor according to claim 7, characterised in that a freely-rotatable pin extends axially through the hollow shaft and has end portions outside the discs for engaging opposed links of the chains.

* * * * *

UNITED STATES PATENT AND TRADEMARK OFFICE

CERTIFICATE OF CORRECTION

PATENT NO. : 5,216,949

DATED : June 8, 1993

INVENTOR(S) : Fausto BERTOZZI

It is certified that error appears in the above-identified patent and that said Letters Patent is hereby corrected as shown below:

On the title page, please insert the following:

-- [30] Foreign Application Priority Data

11/14/91 [IT] Italy MI 91 A 003032 --

Signed and Sealed this

Nineteenth Day of July, 1994

Bruce Lehman

*Attest:*

BRUCE LEHMAN

*Attesting Officer*

*Commissioner of Patents and Trademarks*